US011891837B2

(12) United States Patent
Porter

(10) Patent No.: US 11,891,837 B2
(45) Date of Patent: Feb. 6, 2024

(54) TOPPER POOL COVER

(71) Applicant: Franklin Lloyd Porter, Sioux City, IA (US)

(72) Inventor: Franklin Lloyd Porter, Sioux City, IA (US)

( * ) Notice: Subject to any disclaimer, the term of this patent is extended or adjusted under 35 U.S.C. 154(b) by 0 days.

(21) Appl. No.: 17/803,163

(22) Filed: Mar. 14, 2022

(65) Prior Publication Data

US 2023/0287698 A1 Sep. 14, 2023

(51) Int. Cl.
*E04H 4/10* (2006.01)

(52) U.S. Cl.
CPC ..... *E04H 4/108* (2013.01); *E04H 4/106* (2013.01)

(58) Field of Classification Search
CPC ..... A47K 3/001; F24S 10/17
USPC ..... D25/2; D24/203–205
See application file for complete search history.

(56) References Cited

U.S. PATENT DOCUMENTS 3,940,809 A * 3/1976 Hughes ..... E04H 4/10 4/499
4,236,259 A * 12/1980 Wendt ..... E04H 4/08 4/498
4,251,889 A * 2/1981 Lof ..... E04H 4/10 4/503
4,270,232 A * 6/1981 Ballew ..... B65D 88/36 126/566
4,458,668 A * 7/1984 Sheldon ..... E04H 4/10 126/565
6,062,243 A * 5/2000 Tuch ..... E04H 15/36 135/124
D585,996 S * 2/2009 Rosene ..... D24/205
10,683,674 B2 * 6/2020 Liu ..... E04H 4/1272

* cited by examiner

*Primary Examiner* — Erin Deery

(57) ABSTRACT

Certain exemplary embodiments can provide a system, which comprises a cover, a set of frame segments, and a set of foam segments. The cover has a circular cross section. The cover defines a set of spaced slots disposed around an outer circumference of the cover. The set of frame segments is coupleable to the outer circumference of the cover.

8 Claims, 12 Drawing Sheets

1000

2000

3000

6000

6000

9000

TOPPER POOL COVER

DETAILED DESCRIPTION

Certain exemplary embodiments can provide a system, which comprises a pool cover, a set of frame segments, and a set of foam segments. The cover has a circular cross section. The cover defines a set of spaced slots disposed around an outer circumference of the cover. The set of frame segments is coupleable to the outer circumference of the cover.

Figure 1:
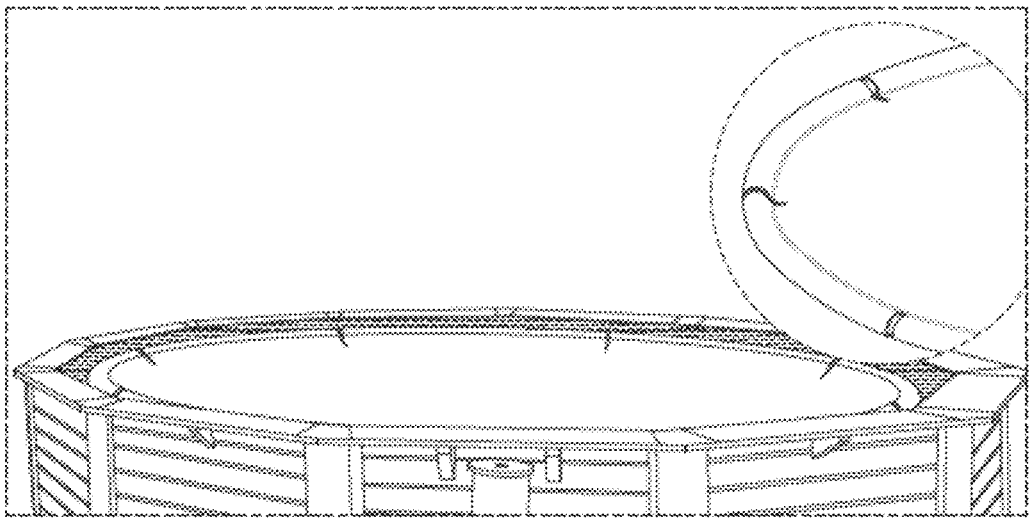
FIG. 1 is a perspective view of an exemplary embodiment of a system 1000.

FIG. 1 is a perspective view of an exemplary embodiment of a system 1000.

The inventor has named the pool cover "Topper™". A Topper comprises a strong vinyl canvas cover. The cover floats on water inside of a pool preventing wind from blowing the cover off. The Topper is easy to set up and break down. The frame is made of flexible PVC tubing with foam padding. There is no need for a pillow underneath the Topper.

Do you have trouble keeping your above ground winter pool cover from blowing off? It can be difficult to keep pool covers on during windy conditions. With Topper™, eliminate the need for a center pillow under your pool cover and prevent wind from blowing it off! This new product is a floating pool cover. It floats on the top of the water instead of being on top of the pool which eliminates the need for a pillow underneath because the cover lays flat on the water. The edge of the cover consists of 8 segments of flexible PVC tubing with foam padding and is easily set up and broken down for storage. Easily close your pool for the winter thanks to Topper.

Figure 2:
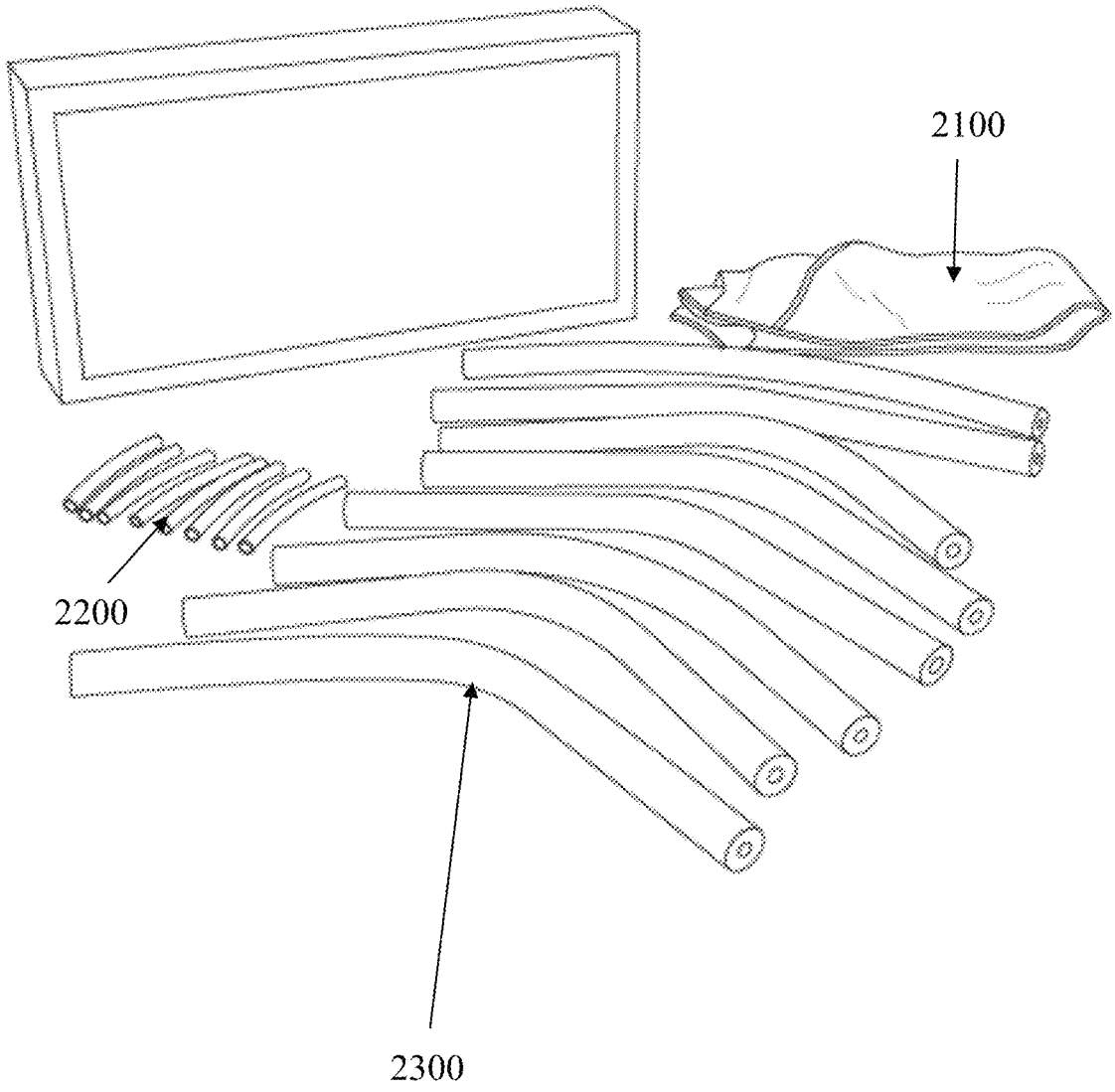
FIG. 2 is a perspective view of an exemplary embodiment of a system 2000.

FIG. 2 is a perspective view of an exemplary embodiment of a system 2000, which comprises a pool cover 2100, a set of frame segments 2200, and a set of foam segments 2300.

Figure 3:
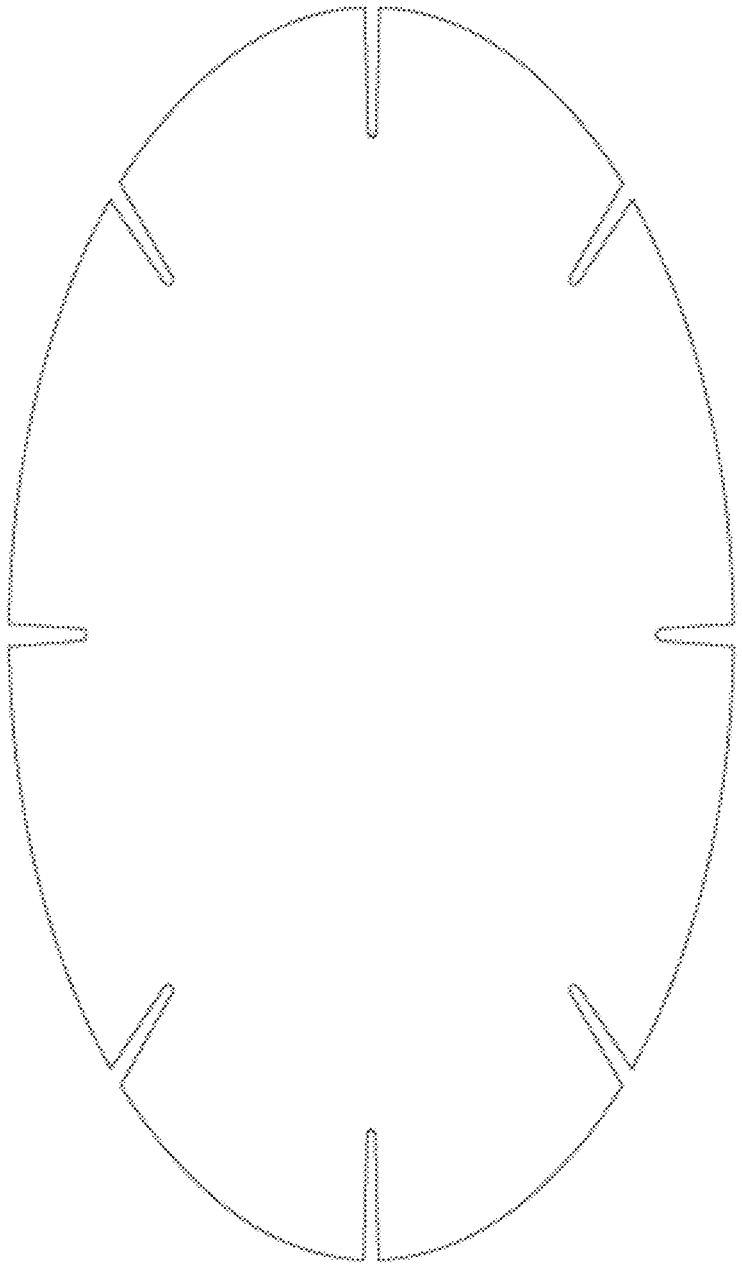
FIG. 3 is a perspective view of an exemplary embodiment of a cover 3000.

FIG. 3 is a perspective view of an exemplary embodiment of a cover 3000.

Figure 4:
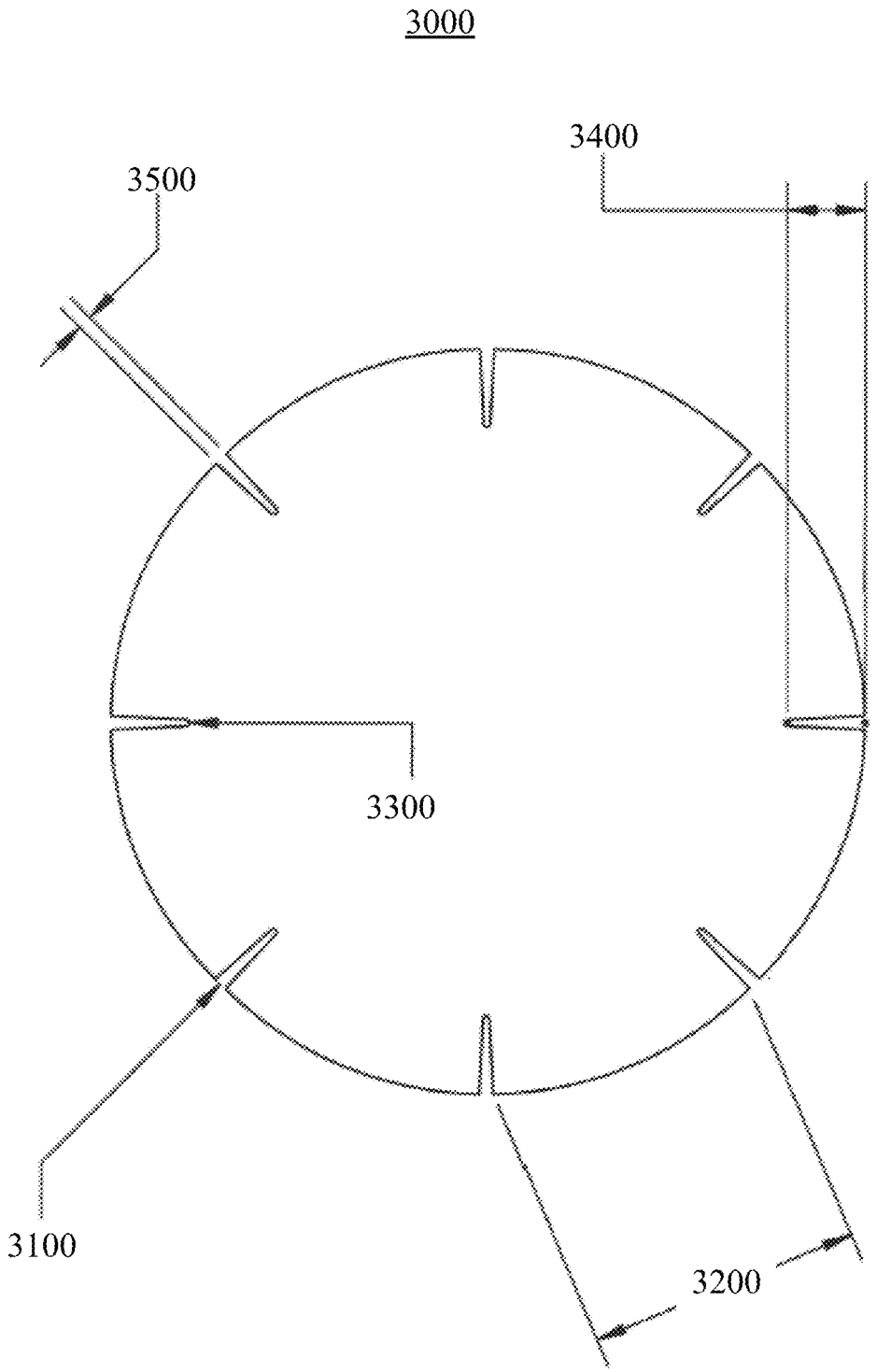
FIG. 4 is a plan view of cover 3000.

FIG. 4 is a plan view of cover 3000, which was designed with the following dimensions:

a cover radius 3100 of 68.00 inches;
a distance between slots 3200 of 49.73 inches;
a slot inner radius 3300 of 0.61 inches;
a slot depth 3400 of 14.09 inches; and
a slot opening width of 2.50 inches.

Figure 5:
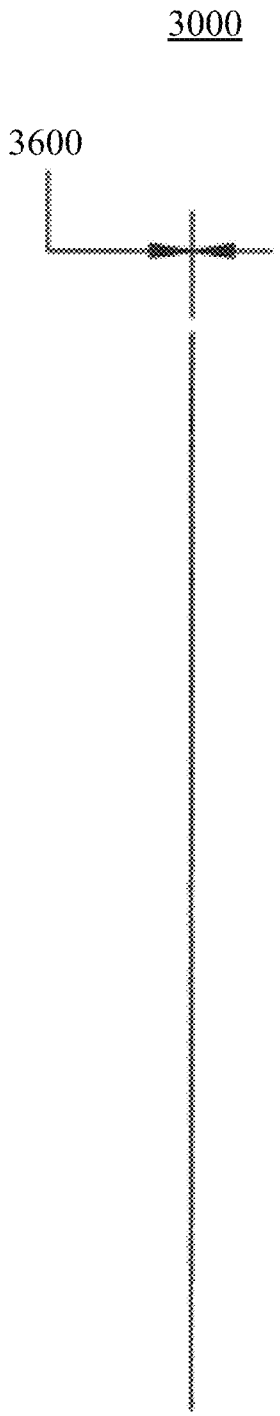
FIG. 5 is a side view of cover 3000.
Figure 6:
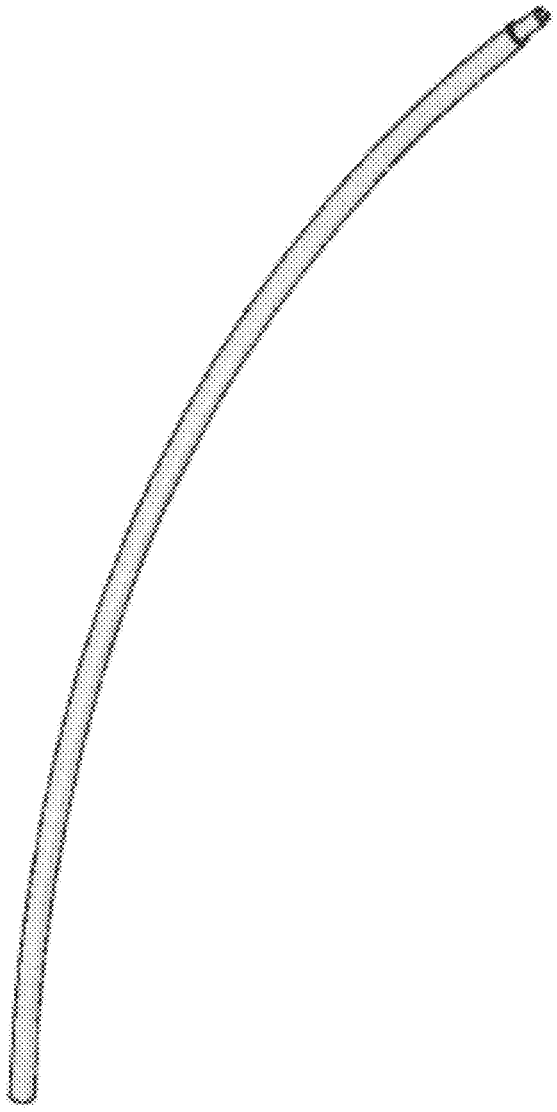
FIG. 6 is a perspective view of an exemplary embodiment of a frame segment 6000.

FIG. 5 is a side view of cover 3000, which has a thickness of 0.05 inches FIG. 6 is a perspective view of an exemplary embodiment of a frame segment 6000.

Figure 7:
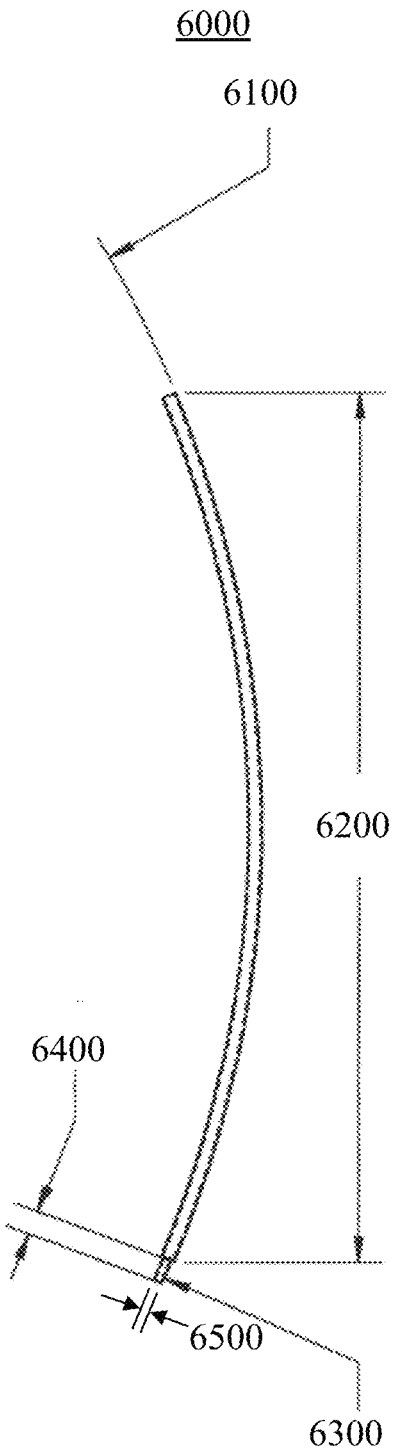
FIG. 7 is a plan view of frame segment 6000.

FIG. 7 is a plan view of frame segment 6000, which was designed with the following dimensions:

a segment radius 6100 of 59.13 inches;
a segment length 6200 of 45.25 inches;
a tip radius 6300 of 59.00 inches;
a tip length 6400 of 1.25 inches; and
a tip diameter 6500 of 0.50 inches.

Figure 8:
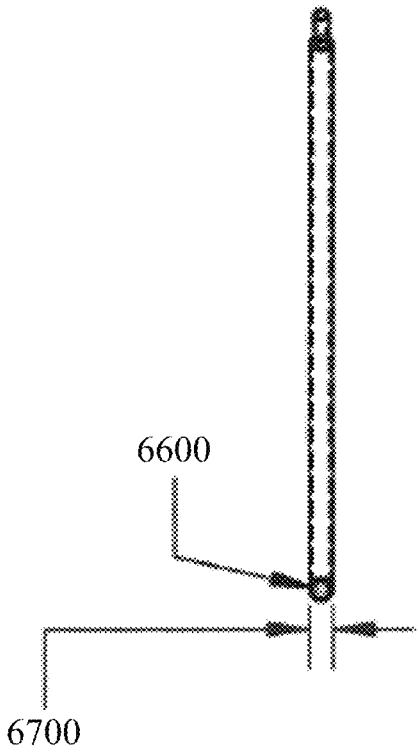
FIG. 8 is a side view of frame segment 6000.

FIG. 8 is a side view of frame segment 6000, which was designed with the following dimensions:

a tip diameter 6600 of 0.55 inches; and
a segment thickness 6700 of 0.75 inches.

Figure 9:
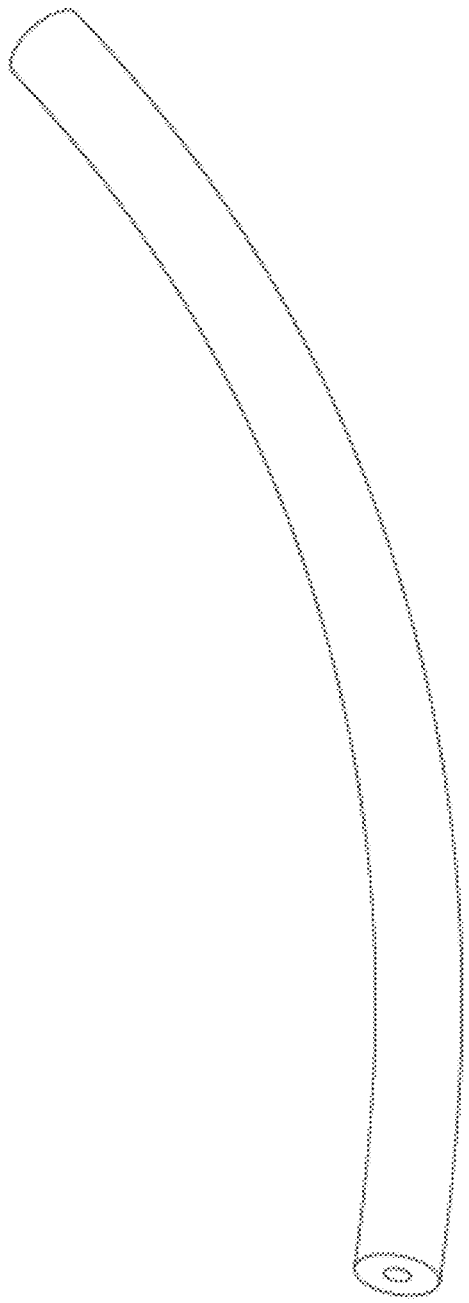
FIG. 9 is a perspective view of an exemplary embodiment of a foam segment 9000.

FIG. 9 is a perspective view of an exemplary embodiment of a foam segment 9000.

Figure 10:
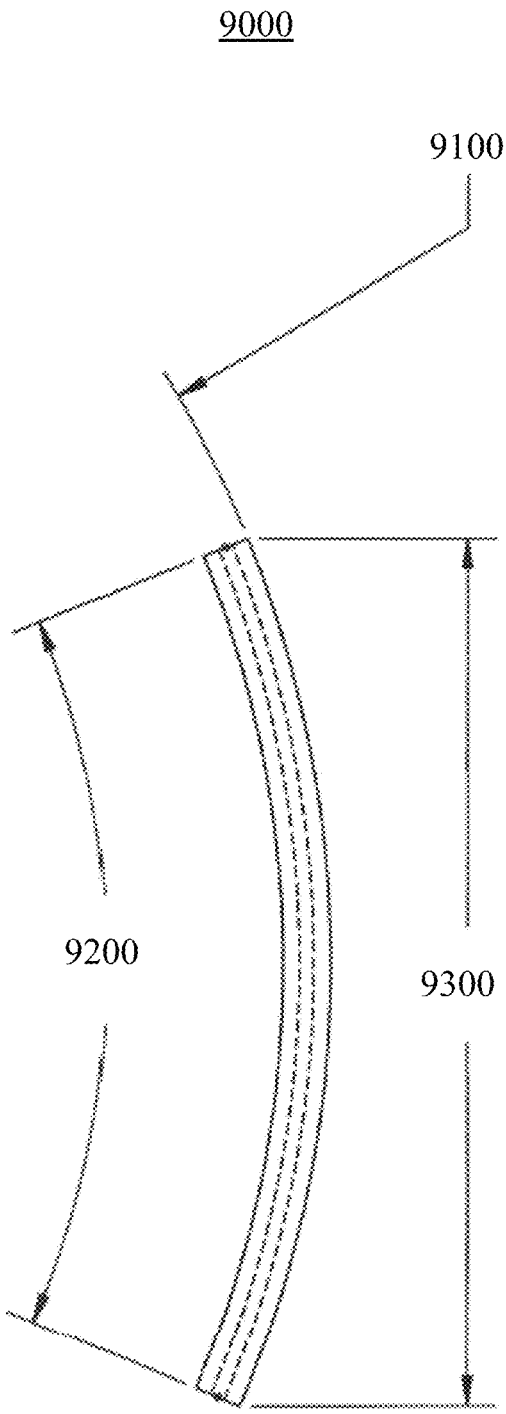
FIG. 10 is a plan view of foam segment 9000.

FIG. 10 is a plan view of foam segment 9000, which was designed with the following dimensions:

a foam segment radius 9100 of 60.00 inches;
an arc scope 9200 of 45 degrees; and
a length 9300 of 45.92 inches.

Figure 11:
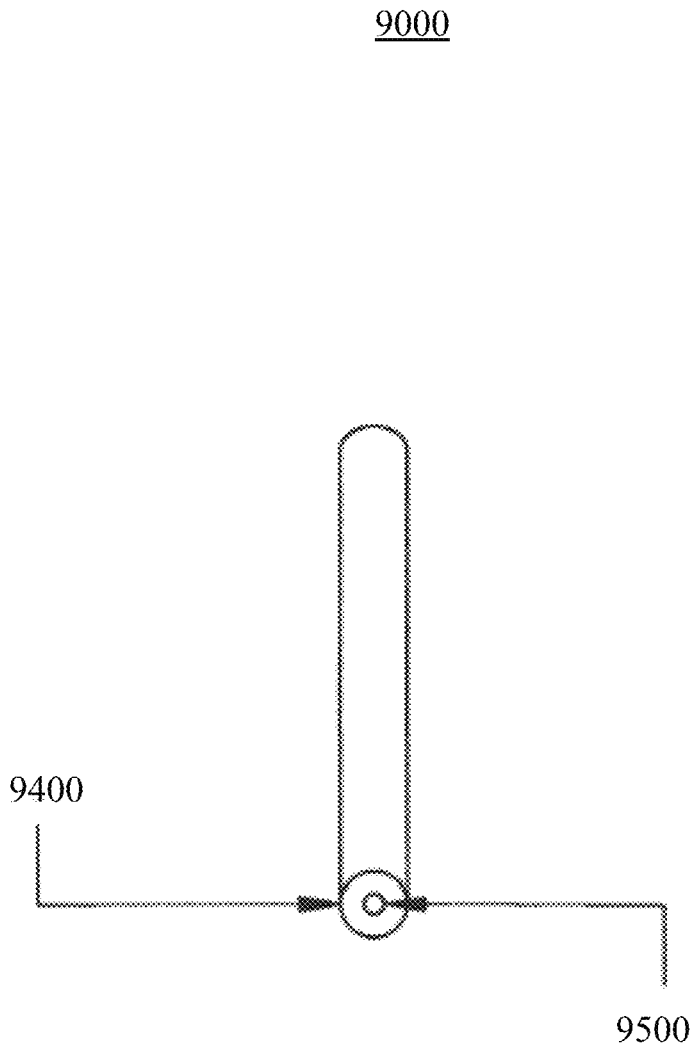
FIG. 11 is a side view of foam segment 9000.

FIG. 11 is a side view of foam segment 9000, which was designed with the following dimensions:

a foam segment outside diameter 9400 of 2.50 inches; and
a foam segment inside diameter 9500 of 0.75 inches.

Figure 12:
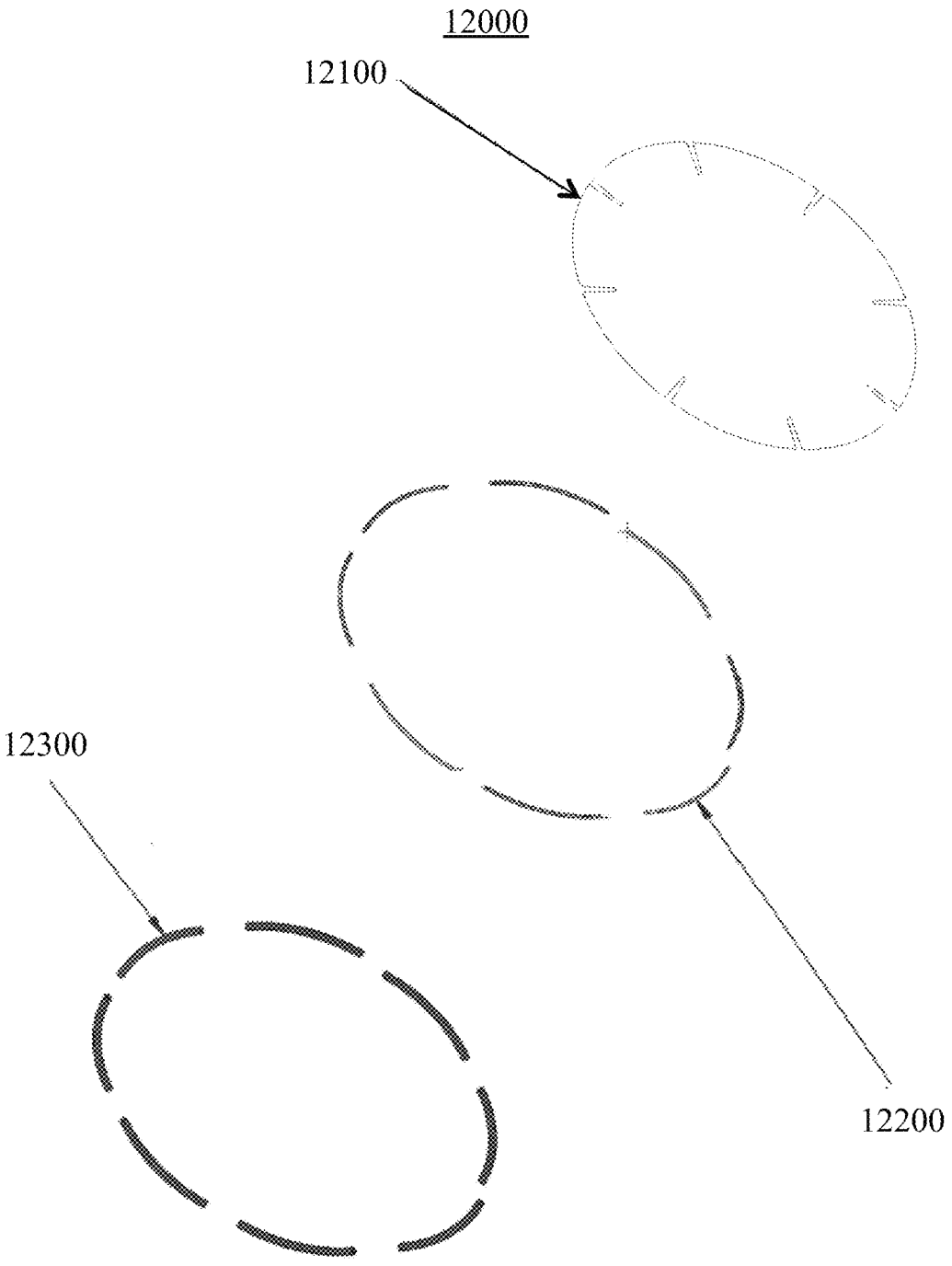
FIG. 12 is a perspective view of an exemplary embodiment of a system 12000.

FIG. 12 is a perspective view of an exemplary embodiment of a system 12000, which comprises a pool cover 12100, a set of frame segments 12200, and a set of foam segments 12300.

Cover 12100 has a circular cross section. Cover 12100 defines a set of spaced slots disposed around an outer circumference of cover 12100. Cover 12100 comprises vinyl.

Set of frame segments 12200 are coupleable to the outer circumference of cover 12100. Set of frame segments 12200 comprises PVC. Each of set of frame segments 12200 has an end with a nipple Set of foam segments 12300 are coupleable to the outer circumference of cover 12100. Each of the set of foam segments has a hollow center.

System 12000 floats on water. System 12000 floats on water inside of a pool. System 12000 lacks a pillow.

What is claimed is:

1. A system comprising:

a cover, the cover having a circular cross section, the cover defining a set of spaced slots disposed around an outer circumference of the cover, each slot of the set spaced slots:

having a first edge and a second edge, wherein each of the first edge and the second edge extends from the outer circumference of the cover in a direction toward a center of the cover to a terminus, the terminus having a curved shape;

having a width and a depth, wherein the depth of each slot is at least two times the width of each slot as measured at the outer circumference of the cover, the width of each slot narrower near the terminus of each slot than as measured at the outer circumference of the cover;

a set of frame segments, the set of frame segments coupleable to the outer circumference of the cover; and a set of foam segments, the set of foam segments coupleable to the outer circumference of the cover.

2. The system of claim 1, wherein:

the system floats on water.

3. The system of claim 1, wherein:

the system floats on water inside of a pool.

4. The system of claim 1, wherein:
the system lacks a pillow.

5. The system of claim 1, wherein:
the set of frame segments comprises PVC.

6. The system of claim 1, wherein:
the cover comprises vinyl.

7. The system of claim 1, wherein:
each foam segment of the set of foam segments has a hollow center, wherein each frame segment is constructed to engage with the hollow center of a corresponding foam segment of the set of foam segments.

8. The system of claim 1, wherein:
each frame segment of the set of frame segments has a first end and a second end, the first end having a nipple, the second end defining a socket, each nipple of each frame segment constructed to engage with a socket of an adjoining frame segment.

* * * * *